US011033775B2

(12) United States Patent
Chen et al.

(10) Patent No.: US 11,033,775 B2
(45) Date of Patent: Jun. 15, 2021

(54) SWINGABLE EXERCISE BICYCLE MECHANISM

(71) Applicant: CHI HUA FITNESS CO., LTD., Hsinchu County (TW)

(72) Inventors: Tai-Chuan Chen, Hsinchu County (TW); Shang-Ta Wu, Hsinchu County (TW)

(73) Assignee: Chi Hua Fitness Co., Ltd., Hsinchu County (TW)

( * ) Notice: Subject to any disclaimer, the term of this patent is extended or adjusted under 35 U.S.C. 154(b) by 29 days.

(21) Appl. No.: 16/543,769

(22) Filed: Aug. 19, 2019

(65) Prior Publication Data

US 2021/0052937 A1 Feb. 25, 2021

(51) Int. Cl.

| | |
|---|---|
| ***A63B 22/06*** | (2006.01) |
| ***A63B 21/04*** | (2006.01) |
| ***A63B 21/02*** | (2006.01) |

(52) U.S. Cl.

CPC ..... *A63B 22/0605* (2013.01); *A63B 21/023* (2013.01); *A63B 21/0428* (2013.01); *A63B 2022/0641* (2013.01)

(58) Field of Classification Search

CPC ... A63B 22/06–0605; A63B 2022/0611–0658; A63B 23/0476; A63B 69/16; A63B 2069/161–168; A63B 21/0428; A63B 21/023

See application file for complete search history.

(56) References Cited

U.S. PATENT DOCUMENTS

| | | | | |
|---|---|---|---|---|
| 9,630,051 | B2 * | 4/2017 | Lin | A63B 21/225 |
| 9,987,514 | B1 * | 6/2018 | Tung | A63B 22/16 |
| 10,039,954 | B1 * | 8/2018 | Tung | A63B 22/0605 |
| 10,238,913 | B1 * | 3/2019 | Tung | A63B 22/0605 |
| 10,617,908 | B2 * | 4/2020 | Lin | A63B 21/225 |
| 2012/0071301 | A1 * | 3/2012 | Kaylor | A63B 22/0605 482/57 |
| 2015/0111704 | A1 * | 4/2015 | Lin | A63B 22/0605 482/57 |
| 2015/0238808 | A1 * | 8/2015 | Lin | A63B 22/0023 482/57 |
| 2016/0287931 | A1 * | 10/2016 | Tung | A63B 22/16 |
| 2019/0070456 | A1 * | 3/2019 | Tung | A63B 22/0605 |
| 2020/0061409 | A1 * | 2/2020 | Lin | A63B 22/0605 |

* cited by examiner

*Primary Examiner* — Andrew S Lo
(74) *Attorney, Agent, or Firm* — Rosenberg, Klein & Lee

(57) ABSTRACT

A swingable exercise bicycle mechanism includes a base frame, two fastening seats at the front and rear, two extension springs arranged symmetrically in pairs connecting with the fastening seats, at least one sliding shaft extending between and being supported by the two fastening seats, a slider arranged on the sliding shaft, and a buffer arranged between each of the two fastening seats and the slider. An exercise bicycle is secured onto the top surface of slider. When a user swings their body on the exercise bicycle, the slider causes the fastening seats to rotate, and simultaneously generate a torque in the opposite direction, which enhances the swinging effect of the exercise bicycle. By moving the user's body back and forth, the exercise bicycle applies reciprocating component forces, which causes shifting of the slider, whereby damping by the buffer device is overcome to achieve the effect of intense exercise.

7 Claims, 11 Drawing Sheets

SWINGABLE EXERCISE BICYCLE MECHANISM

BACKGROUND OF THE INVENTION

1. Field of the Invention

The present invention relates to a swingable exercise bicycle, especially to one that is able to swing left and right and shaft back and forth, which achieves intense exercise.

2. Description of the Related Art

Exercise bicycles enhance body muscles by pedaling in situ which drives a turning gear to rotate. When the weather is bad or people are lacking time to do outdoor exercise, an exercise bicycle provides a choice for indoor exercise. Unfortunately, users easily feel bored about pedaling. Also, an unchanged posture has a negative effect on the human body FIG. 1 illustrates a swingable exercise bicycle, Taiwan patent publication No M314622, an improved version compared with the traditional one which is boring and has a negative effect on the human body, comprising a saddle supporting frame 920, a saddle 960, a buffer base 950, a buffer 930, and a reciprocating device 940. Therefore, the saddle supporting frame 920 and a pin joint part 921 determine the rotation direction, and the torque of rotation makes the saddle supporting frame 920 press the buffer 930. A buffer 930 is arranged at the both sides of saddle supporting frame, and each buffer 930 is connected slantingly to the saddle supporting frame 920. Whereby, arranging the buffers 930 slantingly and the reciprocating device 940 achieve the effect of simulating the shaking and bouncing of riding a bicycle outdoors.

Also, the swingable exercise bicycle can swing left and right and up and down. A user's small body movements, which change the center of weight, can easily cause the buffers 930 and the reciprocating device 940 to provide the function of shaking the saddle support frame 920, but it cannot achieve the purpose of a workout and sweating profusely.

SUMMARY OF THE INVENTION

It is a primary objective of the present invention to provide a swingable exercise bicycle mechanism which swings left and right repeatedly by shaking users' body.

It is another objective of the present invention to provide a swingable exercise bicycle mechanism which takes users' huge efforts to change the center of weight to generate component forces for reciprocating that causes shifting of the bicycle.

In order to achieve the above objectives, a swingable exercise bicycle includes a base frame, pedestals at the front and rear with pivots inside, two extension springs arranged symmetrically in pairs connecting with fastening seats, and the fastening seats pivot at both sides and an opposite torque from the symmetrically arranged extension springs. There is at least one sliding shaft corresponding to the locating hole of a corresponding fastening seat; a slider having at least one shaft hole on a horizontal axis and arranged on a sliding shaft, make the slider slide back and forth on the sliding shaft. A buffer is arranged between the slider and the fastening seat, generating a damping effect when slider moves on the sliding shaft. A swingable exercise bicycle includes a bicycle frame, a bicycle handle, a saddle, pedals and a turning gear, and the bottom of bicycle frame is secured onto the top of slider.

Whereby when a user starts pedaling and applies force to the bicycle frame by swinging of the user's body, the slider drives the fastening seat to rotate the swinging effect of the exercise bicycle; the center of gravity moves by the shaking of the user's body back and forth and thereby applies axially reciprocating component forces which makes the slider shift back and forth, and by overcoming the damping of the buffer an intense exercise effect is achieved.

Also, the swingable exercise bicycle mechanism includes a brake arranged on the front edge of the slider, a lever and a stop mechanism. When the lever is rotated, the stop mechanism is displaced to press against the sliding shaft and stops slider from moving on the sliding shaft.

Furthermore, the swingable exercise bicycle includes a locking device with a locking bar passing through the base frame and affixing the fastening seat at an inner side of the base frame.

Moreover, the swingable exercise bicycle mechanism has a bearing inside the pivot hole of each of the fastening seats and each fastening seat is set on a corresponding pivot of the base frame to increase ease of rotation of the fastening seats.

Yet, in the swingable exercise bicycle mechanism both sides of slider have a linear bearing, and each linear bearing has at least one bearing hole corresponding to the sliding shaft, thereby making the slider move smoothly on the sliding shaft.

Yet, in the swingable exercise bicycle mechanism a buffer has two pairs of return springs. Each pair of return springs is connected with a corresponding linear bearing and a respective fastening seat.

Yet, in the swingable exercise bicycle mechanism an elastic band surrounds each fastening seat and a rubber wheel.

A fastening seat is set at a front and a rear side, the slider is set on a sliding shaft, the sliding shaft passes through the fastening seats and the bicycle frame is secured on the top surface of the slider. When a user swings their body left and right and applies force to the bicycle frame, the slider drives the fastening seats to repeatedly rotate, and the extension springs arranged on the opposite sides of the slider generate a torque in opposite directions to achieve the effect of enhancing the swinging of the bicycle.

Between the slider and each fastening seat said there is extension springs, the elastic band, or any other types of buffer. Therefore, when a user moves back and forth intensely and is pedaling the bicycle, it applies component forces to the sliding shaft which makes the slider move reciprocally. Whereby overcoming of damping of the reciprocal movement achieves the effect of intense exercise.

DETAILED DESCRIPTION OF THE PREFERRED EMBODIMENT

Figure 1:
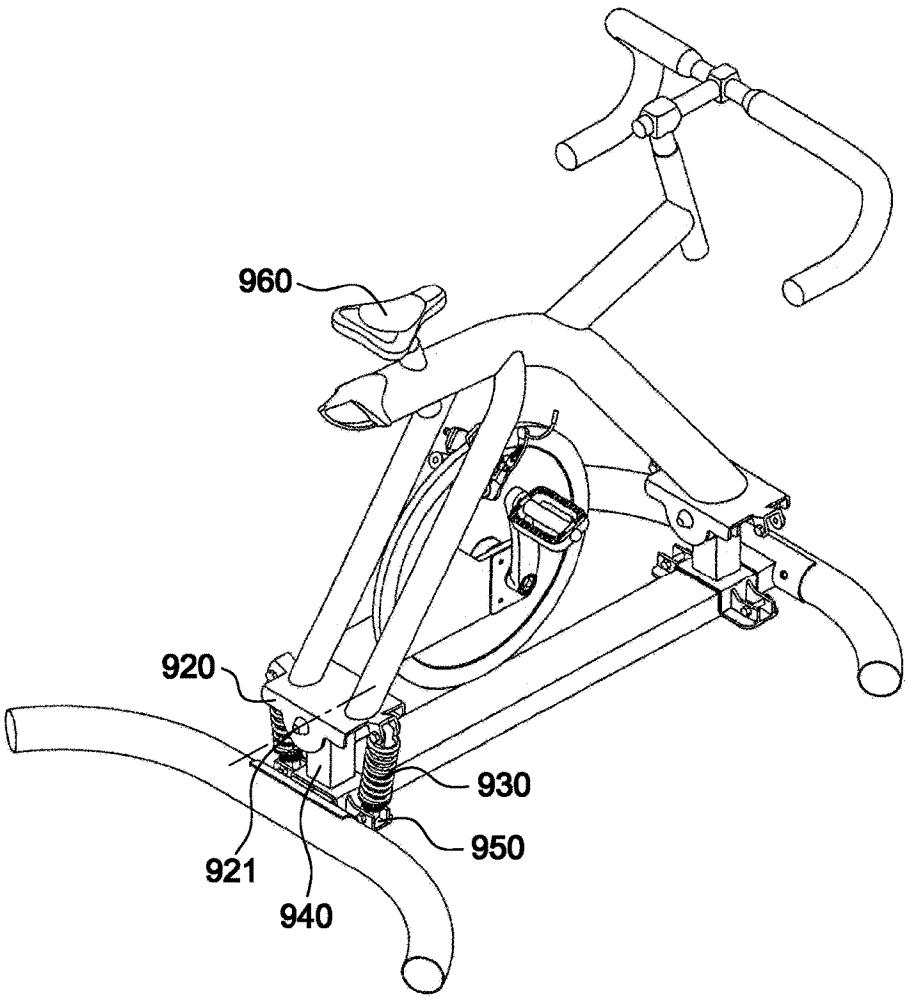
FIG.1 PRIOR ART
FIG. 1 is a swingable exercise bicycle according to the prior art.
Figure 2:
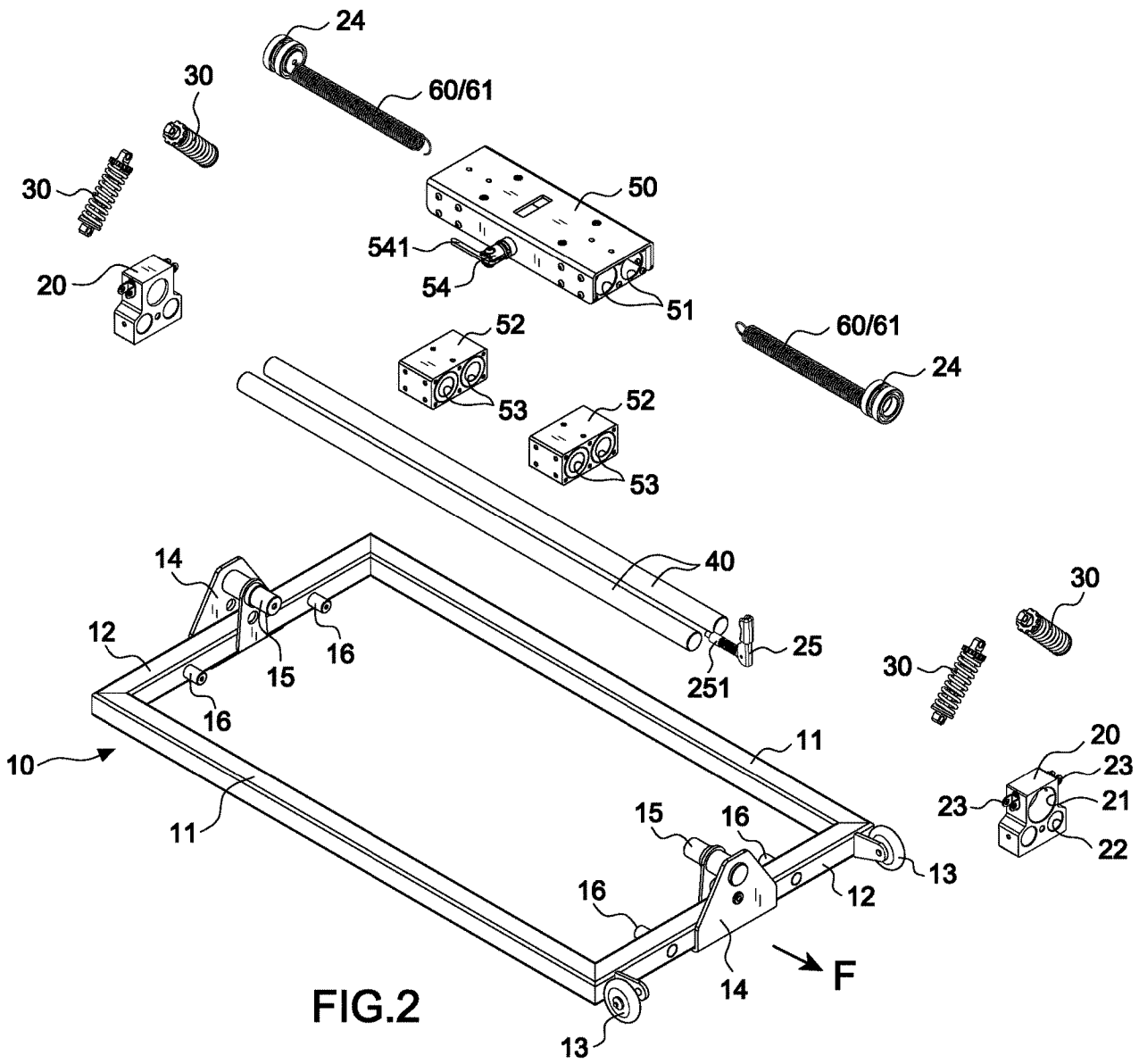
FIG. 2 is an exploded perspective views of the present invention in a first applicable embodiment.
Figure 3A:
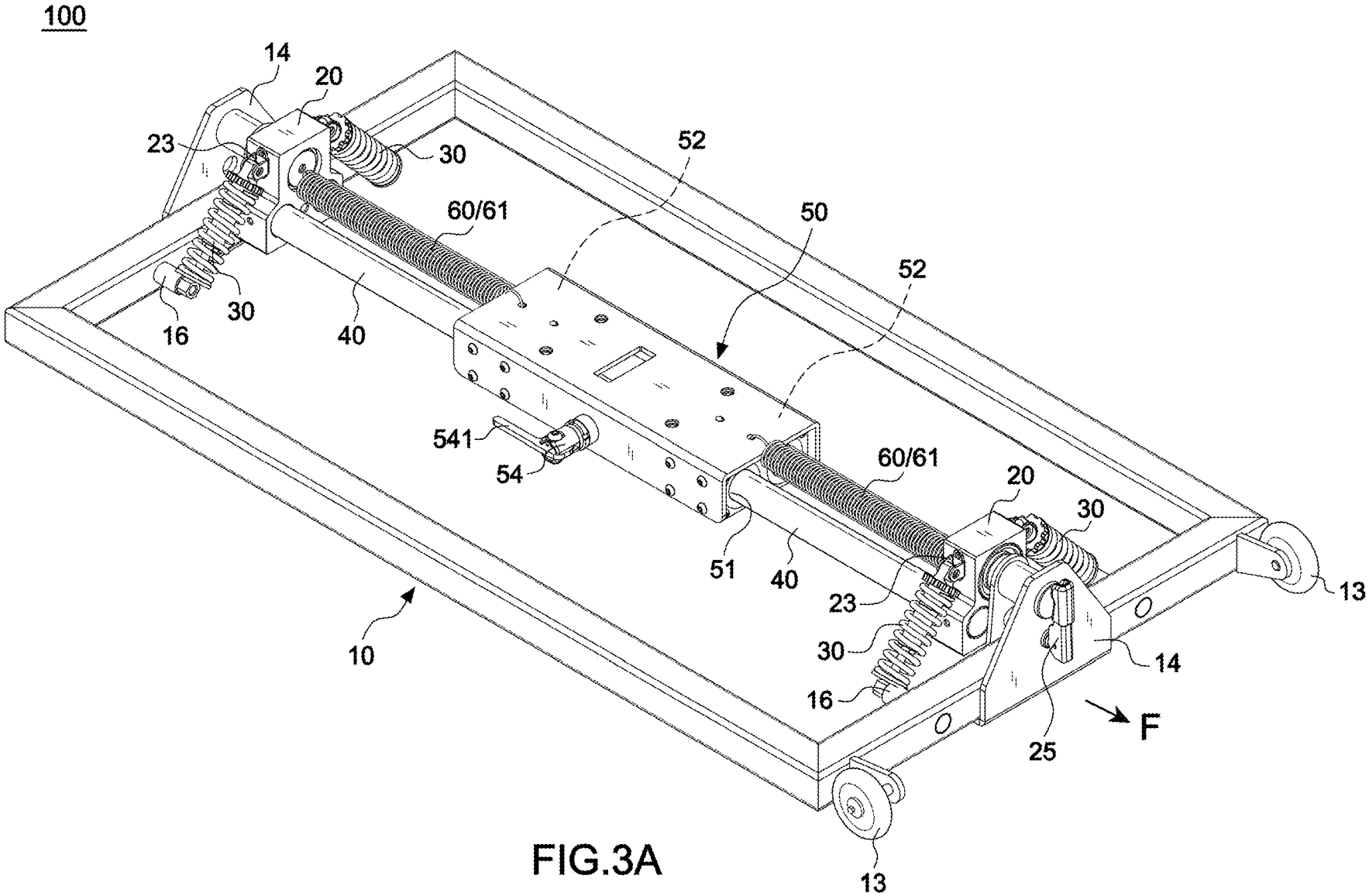
FIG. 3A is an assembly perspective views of the present invention in a first applicable embodiment.
Figure 3B:
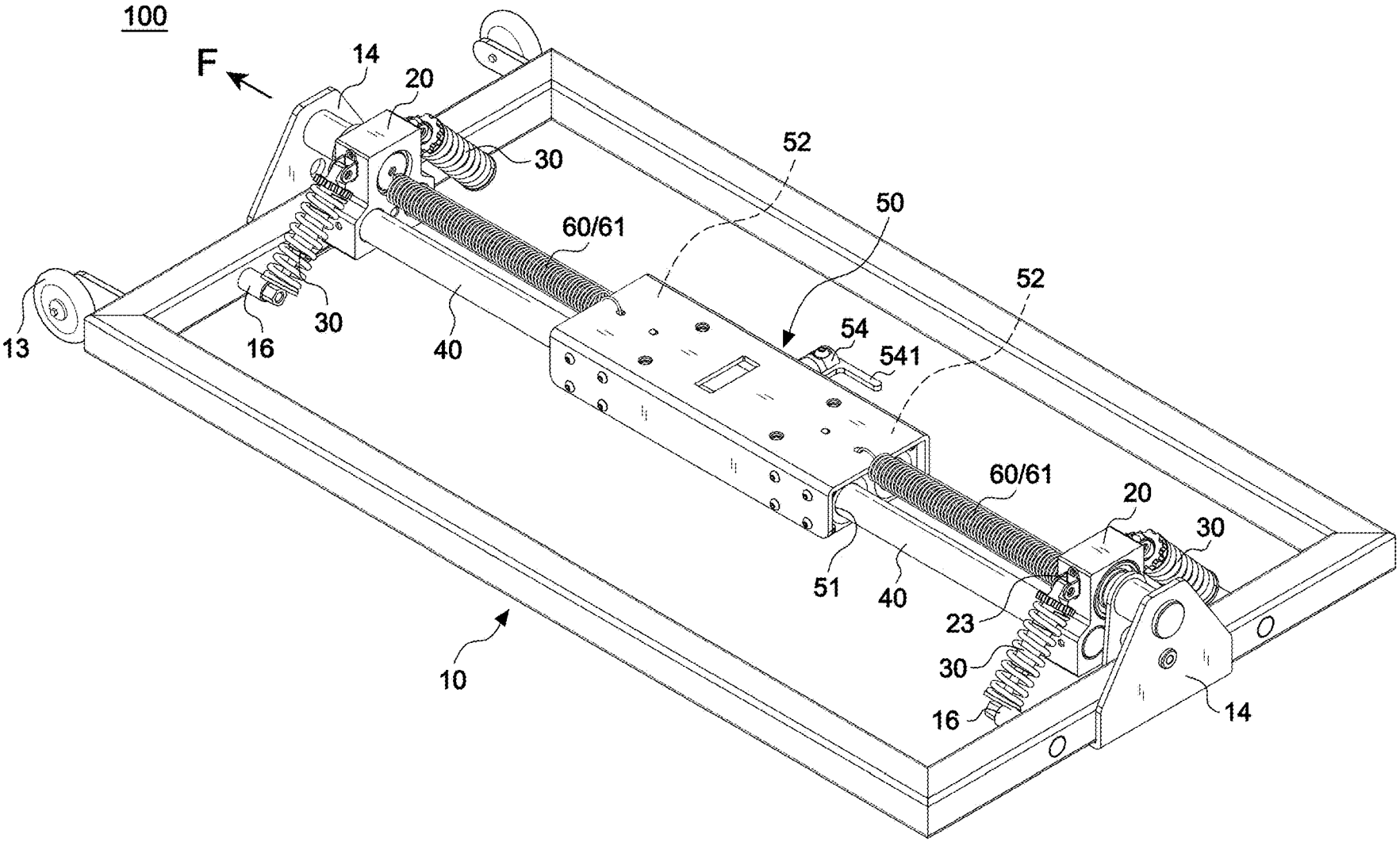
FIG. 3B is second assembly perspective views of the present invention in a first applicable embodiment.
Figure 3C:
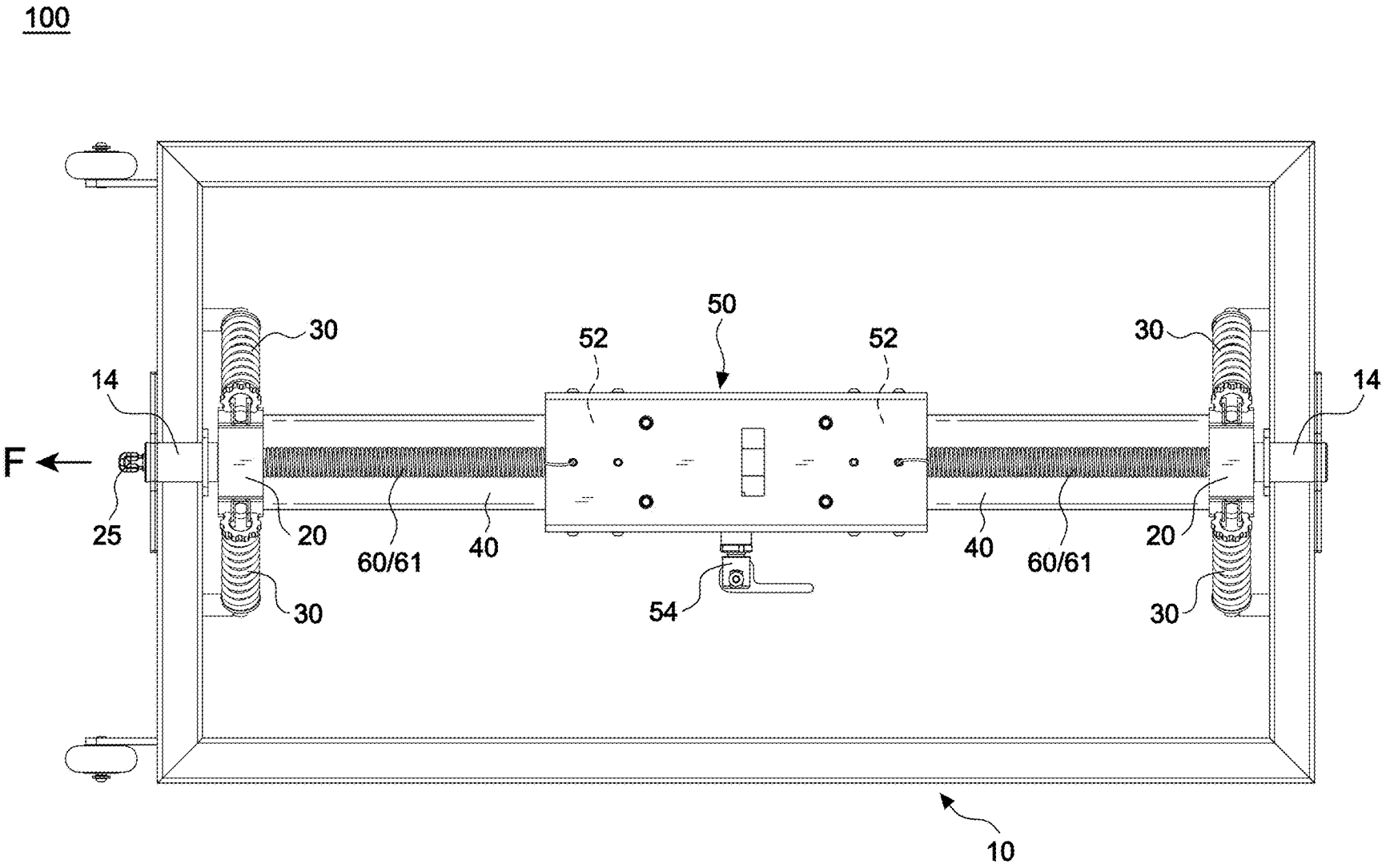
FIG. 3C is an assembly top view of the present invention in a first applicable embodiment.

Referring to FIG. 2 and FIG. 3A-3C, in a first applicable embodiment, a swinging and shifting mechanism 100 mainly includes a base frame 10 which is formed by two crossbars 11 and two straight bars 12 making the base frame 10 able to sit horizontally on the ground.

At the front of one straight bar 12 is a pair of rubber tire 13 respectively adjacent both ends thereof. Thereby, the frame is easy moved with the rubber tires 13, with the rear side of the base frame 10 being liftable. In the middle of each straight bar 12 there is a pedestal 14, each pedestal 14 has a pivot 15 extending toward an inside of the base frame 15; and adjacent each pedestal 14 there are two hanging rods 16 on straight bar 12.

Each of two fastening seats 20 has a pivot hole 21, at least one locating hole 22 and hanging part 23. In a first applicable embodiment, each fastening seat 20 has two locating holes 22. Two bearings 24 are respectively arranged inside the pivot hole 21 of the two fastening seats 20 into which a corresponding pivot 15 is received. Each bearing 24 increases the ease of rotating of the respective fastening seats 20. Four extension springs 30 are arranged symmetrically in pairs, each extension spring 30 is connected with one of a pair of hanging parts 23 of a respective fastening seat 20 and a corresponding hanging rod 16 of base frame 10. When fastening seat 20 rotates, the extension springs 30 apply torque in an opposite direction to that of the corresponding fastening seat 20.

In a first applicable embodiment the at least one sliding shaft 40 is represented by two sliding shafts 40 corresponding to the locating holes 22 of the fastening seats 20. Each sliding shaft 40 is received in a respective one of the locating holes 22 of each of the fastening seats 20. A slider 50 has a pair of shaft holes 51 on opposing sides thereof on a horizontal axis, and each of the opposing sides of slider 50 have a linear bearing 52 received therein. Each linear bearing 52 has a pair of bearing holes 53. Each sliding shaft 40 passes through a corresponding one of the two shaft holes 51 and two bearing holes 53 on each end of the slider 50, whereby the slider 50 can slide smoothly on the sliding shafts 40. A locking device has a locking bar 25 with a screw 251 at the front of the locking bar 25 for locking one of the fastening seats 20 to a corresponding one of the pedestals 14, to thereby affix the two fastening seats 20 and sliding shafts 40 between both pedestals 14. A buffer 60 produces a damping effect while the slider 50 slides on the sliding shafts 40. In the first applicable embodiment, the buffer 60 includes two return spring 61. Each return spring 61 connect with a respective one of the linear bearings 52 and a corresponding fastening seat 20. The two return springs 61 produce a damping effect while slider 50 slides on the sliding shafts 40. The front edge of the slider 50 has a brake 54. The brake 54 has a stop mechanism (not shown) and an operation lever 541. Rotation of the operation lever 541 displaces the stop mechanism to press against a corresponding sliding shaft 40, therefore the slider 50 will stop sliding on the sliding shafts 40.

Figure 4:
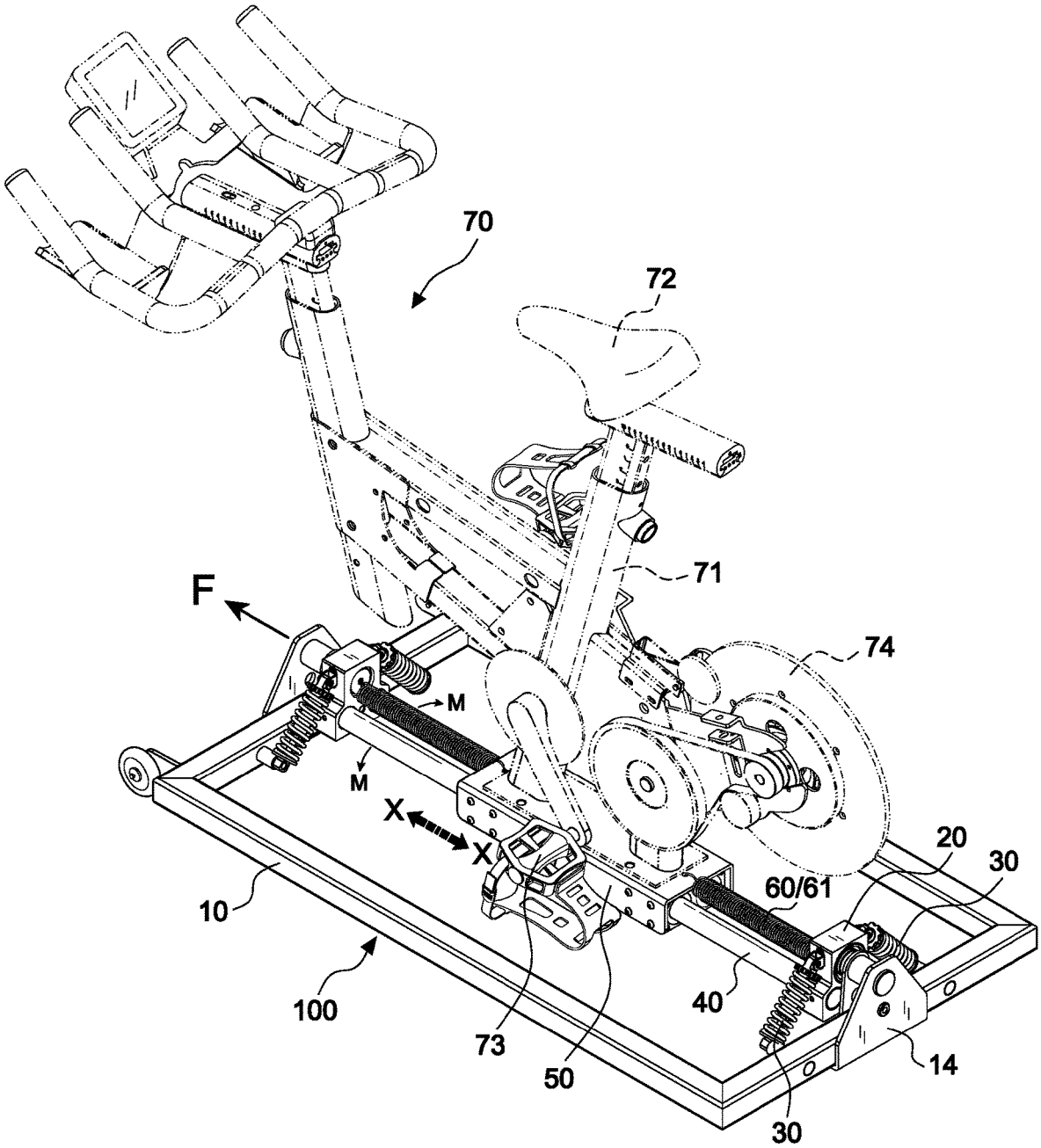
FIG. 4 is an assembly perspective views of the present invention.
Figure 5:
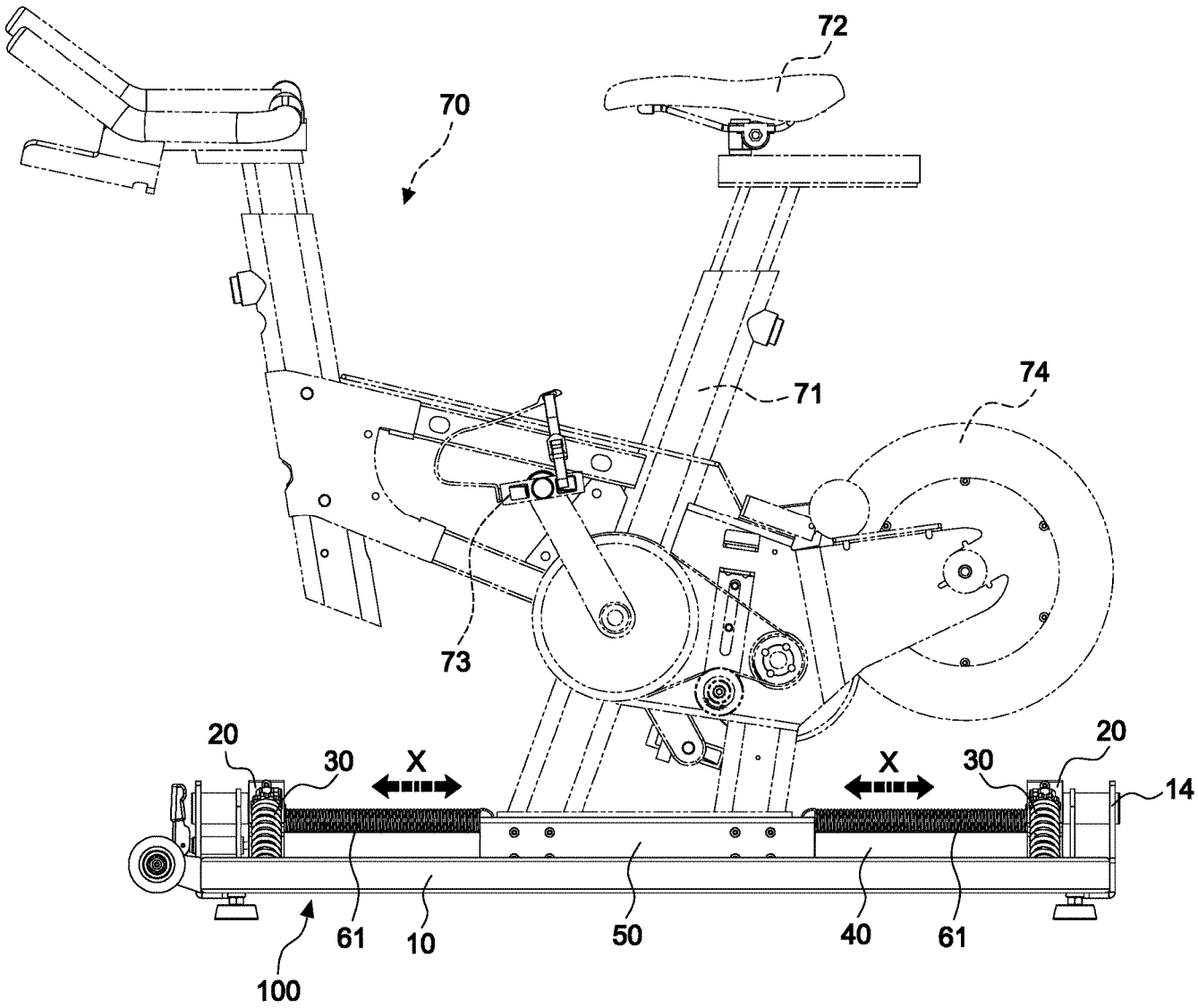
FIG. 5 is an assembly side views of the present invention.

FIGS. 4-5 illustrate an exercise bicycle 70 assembled on the swinging and shifting mechanism of the present invention. The exercise bicycle 70 includes a bicycle frame 71, a saddle 72, pedals 73, and a tuning gear 74, and the bottom of the bicycle frame 71 is secured on to the top of the slider 50. Wherein, a user's pedaling applies force to the bicycle frame 71, causing the fastening seat 20 to rotate, and then the extension springs 30 provide torque M in an opposite direction (see FIG. 6) which enhances the effect of swinging of the exercise bicycle 70. Moreover, the user can lift their buttock out of the saddle 72 for centralizing their weight on the pedals 73 and shaking intensely back and forth, which applies component forces in the direction of the X axis, causing a reciprocating motion that causes the slider 50 and exercise bicycle 70 to shift on sliding shaft 40. The present invention thereby achieves the effect of intense exercise by overcoming the damping of the return springs 61 of the buffer 60.

Figure 6:
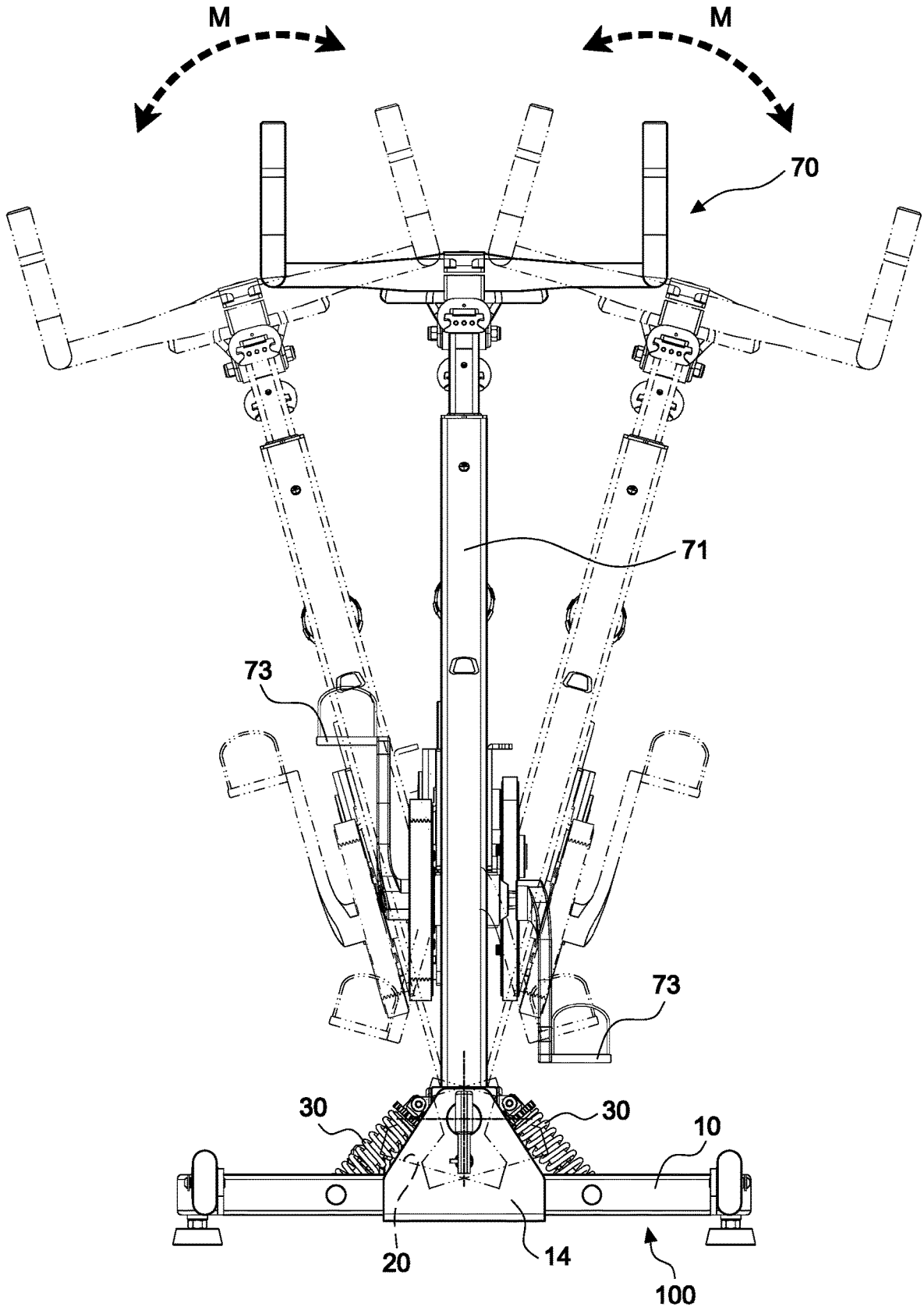
FIG. 6 is an assembly rear views of the present invention.

FIG. 6 illustrates the situation of the exercise bicycle 70 while swinging. The two fastening seats 20 arranged on pedestals 14 are located on both sides of the base frame 10. The pairs of extension springs 30 are symmetrically connected respectively to the fastening seats 20, the slider 50 is arranged on sliding shafts 40, and the bicycle frame 71 is secured onto the top surface of the slider 50. When a user applies force to the bicycle frame 71 by shaking their body, that causes the fastening seats 20, the slider 50 and exercise bicycle 70 to rotate in either direction with the pivots 15 as a rotative axis. One extension spring 30 of each pair of extension springs will be compressed, while the other extension spring 30 of each pair of extension springs is stretched to thereby produce a rotative torque M. Once a user reduces the force applied to the bicycle frame 71, the torque M induces the user to swing their body to the other side, and creating a new torque M in the opposite direction. Whereby, the purpose of swinging repeatedly is achieved.

Figure 7:
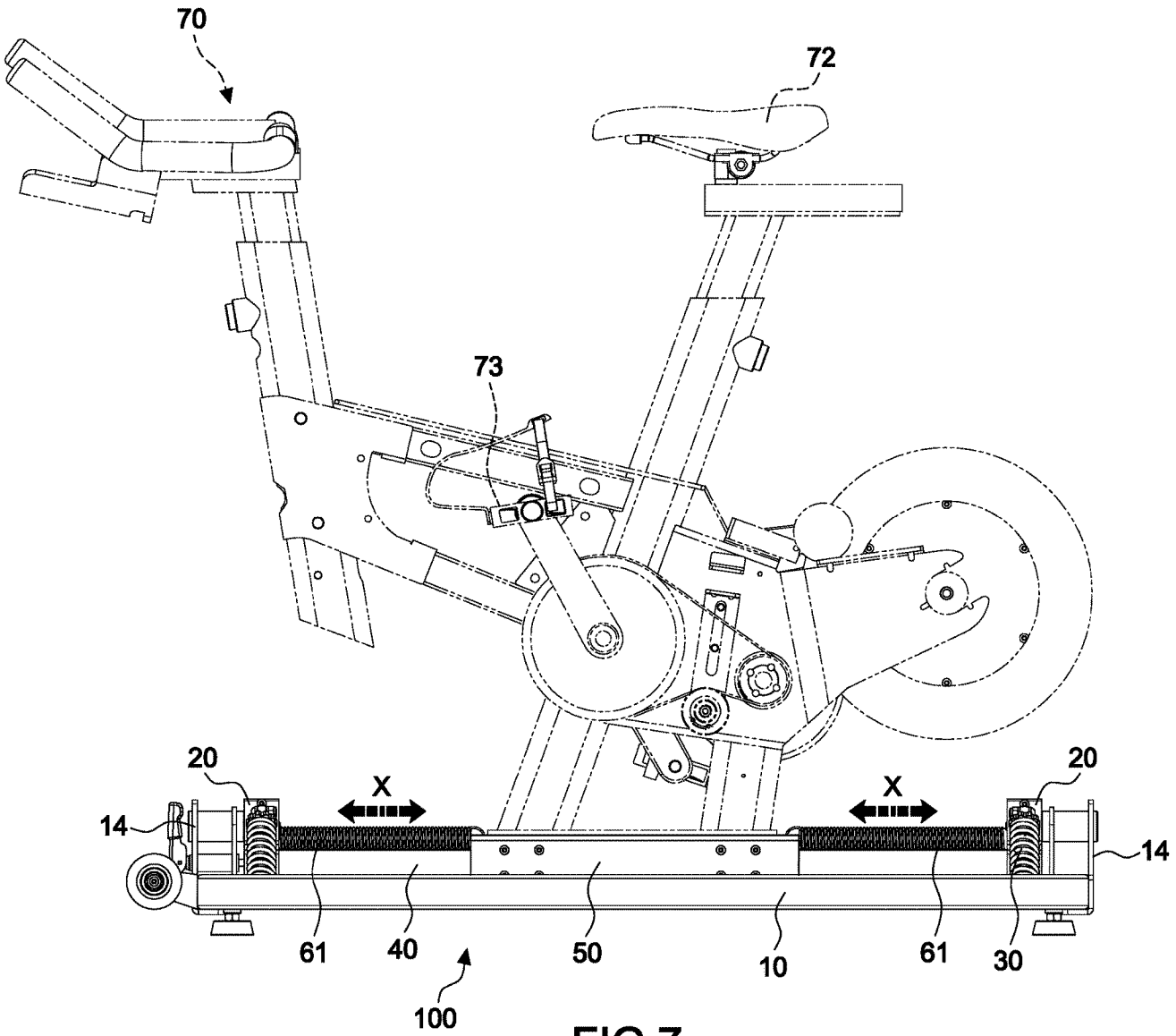
FIG. 7 is a schematic diagram illustrating shifting back and forth of the present invention.

FIG. 7 illustrates the situation of exercise bicycle 70 while shifting to-and-fro. Two fastening seats 20 are arranged on pedestals 14 that are located on the base frame 10. The pairs of extension springs 30 are coupled to the fastening seats 20 at the pedestals 14, The sliding shafts 40 extend between and are supported by the two fastening seat 20. The slider 50 is arranged on the sliding shafts 40, and the bicycle frame 71 secured onto the top surface of the slider 50. A pair of return spring 61 is connected to the slider 50 and two fastening seats 20. Rather than just swing the user's body smoothly on the exercise bicycle 70, the user can also lift their buttock out of the saddle for centralizing their weight on the pedals 73. When pedaling, a user applies force to the bicycle frame 71, generating component forces in the direction of the X axis causing a reciprocating motion which causes the exercise bicycle 70 to shift on the sliding shafts 40. Since the user needs to overcome the damping of the buffer 60, which is bigger than the component forces, it requires the user to pedal harder and move their body to a greater extent, which achieves the effect of increasing the intensity of the exercise.

Figure 8:
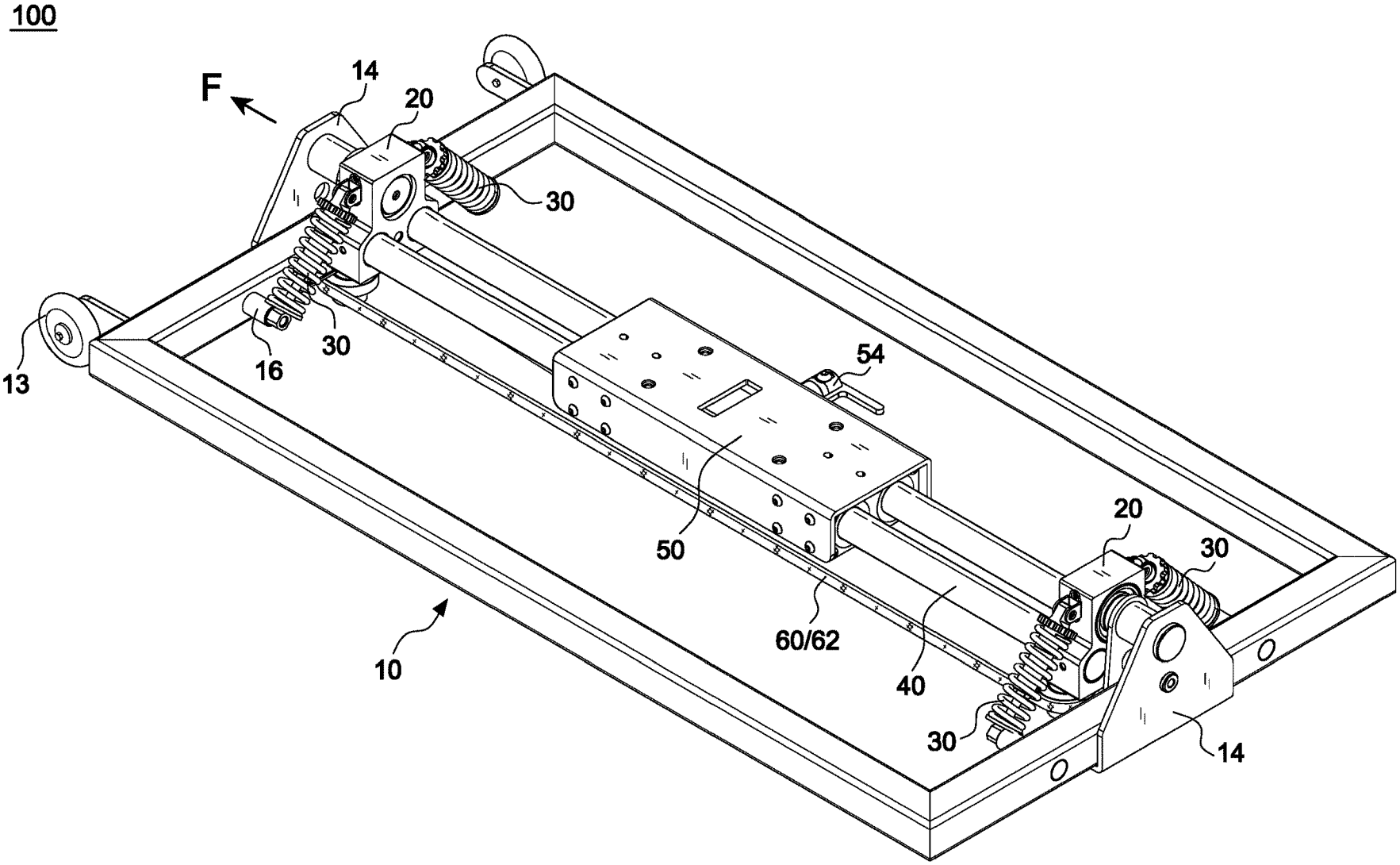
FIG. 8 is an assembly perspective view of the present invention in a second applicable embodiment.
Figure 9:
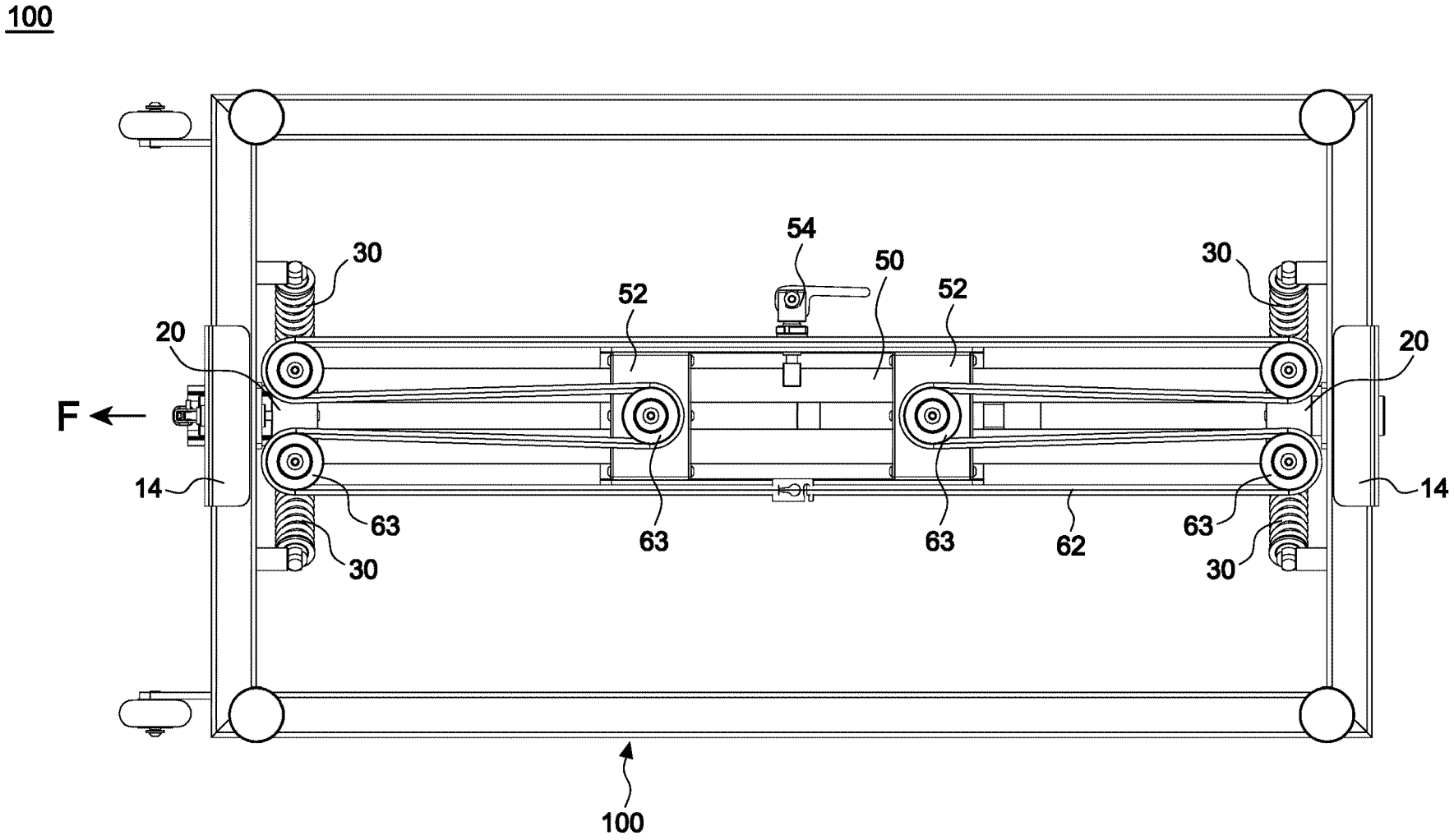
FIG. 9 is an assembly bottom view of the present invention in a second applicable embodiment.

FIGS. 8-9 illustrate a second applicable embodiment of swinging and shifting mechanism 100, wherein other than the arrangement of the buffer 60, the mechanism in this embodiment is the same as that of the first applicable embodiment. The buffer 60 includes an elastic band 62 which serpentines between the fastening seats 20 and is threaded around a plurality of band wheels 63 among the linear bearings 52 and the fastening seats 20. The elastic band 62 produces damping between slider 50 and the fastening seats 20.

The present invention has a fastening seat 20 at both the front and rear of the base frame 10, a slider 50 arranged on sliding shafts 40, and the bicycle frame 71 is secured onto the top surface of the slider 50. When a user applies force to the bicycle frame 71, by shaking their body, the fastening seats 20 rotate, the slider 50 is linearly displaced and exercise bicycle 70 rotates and the extension springs 30 arranged on opposing sides of each of the fastening seats 20 provide a torque M in an opposite direction, which enhances effect of swinging of the exercise bicycle 70. Moreover, the present invention has return springs 61, an elastic band 62 or any kind of buffer arranged between the slider 50 and each of the fastening seats 20. Whereby, the force of intense shaking by the user's body and pedaling causes the slider 50 to shift in the direction of the X axis on the sliding shafts 40. Also, a user needs to pedal faster and amplify their body movement to resist damping from the buffer 60, so as to achieve the effect of intense exercise.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A swingable exercise bicycle mechanism, comprising:

a base frame having a pedestal at each of a front and a rear of the base frame, each of the pedestals having a corresponding pivot extending toward an inside of the base frame;

two fastening seats, each fastening seat having a pivot hole and at least one locating hole, each of the fastening seats being supported by a respective one of the pedestals by the corresponding pivot thereof being received in the pivot hole of a corresponding one of the fastening seats;

a pair of extension springs being respectively symmetrically connected to each of the fastening seats, each pair of extension springs being configured to produce an opposing torque to rotation of the connected fastening seat about the corresponding pivot;

at least one sliding shaft received in the at least one locating hole of the two fastening seats;

a slider having at least one shaft hole on a horizontal axis thereof and arranged on the at least one sliding shaft for sliding back and forth thereon;

a buffer arranged between the slider and the fastening seats, the buffer generating a damping effect responsive to displacement of the slider on the at least one sliding shaft; and a swingable exercise bicycle including a bicycle frame, a bicycle handle, a saddle, pedals and a turning gear, a bottom of the bicycle frame being secured to a top surface of slider;

whereby when a user starts pedaling and applies a swinging force to the bicycle frame, the slider drives the fastening seats to rotate repeatedly, and the extension springs produce an opposite torque to enhance a swinging effect of the exercise bicycle, and responsive to movement of a user's center of gravity by shaking body back and forth while pedaling, the swingable exercise bicycle mechanism is configured to apply axially directed reciprocating component forces to the slider and cause the slider to shift back and forth, wherein overcoming the damping effect of the buffer achieves an intense exercise effect.

2. The swingable exercise bicycle mechanism as claimed in claim 1, wherein the slider includes a brake having a lever and stop mechanism, the brake stops the slider from moving on the at least one sliding shaft responsive to rotation of the lever.

3. The swingable exercise bicycle mechanism as claimed in claim 1, further comprising a locking device including a locking bar passing through the base frame and affixing a corresponding one of the fastening seats at an inner side of a corresponding pedestal.

4. The swingable exercise bicycle mechanism as claimed in claim 1, wherein each of the fastening seats has a bearing disposed inside the pivot hole thereof and into which the corresponding pivot is received.

5. The swingable exercise bicycle mechanism as claimed in claim 1, wherein the slider includes a linear bearing on two opposing sides thereof and each linear bearing has at least one bearing hole through which the at least one sliding shaft passes.

6. The swingable exercise bicycle mechanism as claimed in claim 5, wherein the buffer includes a pair of return springs, and each return spring being connected between a respective one of the linear bearings and a corresponding one of the fastening seats.

7. The swingable exercise bicycle mechanism as claimed in claim 5, wherein the buffer includes an elastic band threaded around band wheels to serpentine between the fastening seats.

* * * * *